US011246190B2

(12) United States Patent
de Morais et al.

(10) Patent No.: US 11,246,190 B2
(45) Date of Patent: Feb. 8, 2022

(54) COOKING HOB WITH EDGE LIGHTING INDICATING BURNER UNIT USE

(71) Applicant: WHIRLPOOL CORPORATION, Benton Harbor, MI (US)

(72) Inventors: Fernanda M. de Morais, Joinville (BR); Monica C. Monteiro, Joinville (BR); Thayna Oening, Joinville (BR); Nilvania Stefanello, Joinville (BR); Joel Graham Van Faasen, Holland, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 289 days.

(21) Appl. No.: 16/406,306

(22) Filed: May 8, 2019

(65) Prior Publication Data

US 2020/0359470 A1 Nov. 12, 2020

(51) Int. Cl.

| | |
|---|---|
| ***H05B 6/12*** | (2006.01) |
| ***H05B 3/74*** | (2006.01) |
| ***H05B 6/06*** | (2006.01) |

(52) U.S. Cl.

CPC ..... *H05B 6/1218* (2013.01); *H05B 3/746* (2013.01); *H05B 6/062* (2013.01); *H05B 2213/05* (2013.01)

(58) Field of Classification Search

CPC .... H05B 6/062; H05B 6/1218; H05B 6/1245; H05B 6/1254; H05B 6/1263; H05B 6/1272; H05B 3/74; H05B 3/746; H05B 2213/03; H05B 2213/05; F24C 15/00; F24C 15/10; F24C 15/102; F24C 15/105; F24C 7/082; F24C 7/083

USPC ..... 219/620, 622, 624, 662, 671, 672, 675, 219/676

See application file for complete search history.

(56) References Cited

U.S. PATENT DOCUMENTS

| | | | |
|---|---|---|---|
| 7,425,690 | B2 | 9/2008 | Schilling |
| 9,326,328 | B2 | 4/2016 | Corleoni et al. |
| 9,664,375 | B2 | 5/2017 | Guiset et al. |
| 2011/0233196 | A1 | 9/2011 | Bunuel Magdalena et al. |
| 2012/0138590 | A1 | 6/2012 | Brosnan et al. |
| 2013/0270251 | A1 | 10/2013 | Furuti et al. |
| 2018/0124879 | A1 | 5/2018 | Puchinger et al. |
| 2018/0347823 | A1 | 12/2018 | Camanes Vera et al. |

FOREIGN PATENT DOCUMENTS

| | | | | |
|---|---|---|---|---|
| DE | 102014223711 | A1 * | 5/2016 | ..... H05B 6/1218 |
| DE | 102014223711 | A1 | 5/2016 | |
| DE | 102015201324 | A1 | 7/2016 | |
| EP | 2469973 | A1 | 6/2012 | |

(Continued)

*Primary Examiner* — Hung D Nguyen
(74) *Attorney, Agent, or Firm* — Price Heneveld LLP

(57) ABSTRACT

A cooking hob includes a cooktop defining a major surface extending between a plurality of sides and a plurality of edge surfaces extending away from the major surface at respective sides thereof and a plurality of burner units disposed at the major surface within respective sections of the major surface. The cooktop further includes a lighting assembly affixed with the cooktop opposite the major surface and extending adjacent at least two of the sections of the major surface and including a plurality of lighting elements respectively exposed at respective portions of the edge surfaces corresponding with the sections of the major surface.

20 Claims, 6 Drawing Sheets

(56) References Cited

FOREIGN PATENT DOCUMENTS

| | | | |
|---|---|---|---|
| FR | 3008780 | B1 | 3/2018 |
| WO | 2015068093 | A1 | 5/2015 |
| WO | 2018178785 | A1 | 10/2018 |

* cited by examiner

COOKING HOB WITH EDGE LIGHTING INDICATING BURNER UNIT USE

BACKGROUND

The present disclosure generally relates to a cooking hob. In particular, the cooking hob includes an edge lighting assembly with capability to indicate burner unit use.

Various types of cooktops, particularly but not limited to those in the form of induction cooktops, include a solid glass top. These cooktops may be configured to heat cooking articles placed on the glass top using coils, such as electromagnetic induction coils, that are positioned beneath the glass top such that the coils cannot be seen. In the case of induction coils, the coils themselves do not heat to a useful extent and do not undergo a visible change in appearance, such as the characteristic glow of resistive heating element, even when on. Rather, induction coils use electromagnetic induction to cause an article in proximity with the coil and of appropriate construction (including at least a layer with ferromagnetic properties) to generate its own heat. At least because any ferromagnetic articles placed on an induction cooktop can become heated, an indication of induction coil activation may be desired. Some existing induction cooktops provide permanent, static markings on the glass itself to identify where pans and the like can be placed, but these lack any visual communication regarding the state of the burner.

Some solutions have been developed that incorporate lighting into the area of the induction coil, but reliability of such lighting is difficult to achieve because of the high heat associated with the cooking article when heated by the coil, as well as the adjacent electrical components. Accordingly, further advances may be desired.

SUMMARY

In at least one aspect, a cooking hob includes a cooktop defining a major surface extending between a plurality of sides and a plurality of edge surfaces extending away from the major surface at respective sides thereof and a plurality of burner units disposed at the major surface within respective sections of the major surface. The cooktop further includes a lighting assembly affixed with the cooktop opposite the major surface and extending adjacent at least two of the sections of the major surface and including a plurality of lighting elements respectively exposed at respective portions of the edge surfaces corresponding with the sections of the major surface.

In at least another aspect, a cooking hob includes a cooktop defining a major surface extending between a plurality of sides with a corresponding plurality of edges, a plurality of burner units disposed at the major surface within respective sections of the major surface, and a lighting assembly extending along at least one of the plurality of edges. A controller is further included for selectively activating ones of the plurality of burner units and causing the lighting assembly to illuminate a respective portion of at least one of the edges bounding at least one of the sections of the major surface corresponding with the activated ones of the plurality of burner units.

In at least another aspect, a cooking hob includes a cooktop defining a major surface extending between a plurality of sides and a plurality of edge surfaces extending away from the major surface at respective sides thereof and a plurality of burner units disposed at the major surface within respective sections of the major surface. The cooking hob further includes a lighting assembly extending along at least three of the edge surfaces and including a plurality of lighting elements directed outwardly from the edge surfaces adjacent at least portions of each of the sections of the major surface. The lighting elements are selectively illuminable to identify a section of the major surface wherein the associated burner elements are in an active state.

These and other features, advantages, and objects of the present device will be further understood and appreciated by those skilled in the art upon studying the following specification, claims, and appended drawings.

Figure 1:
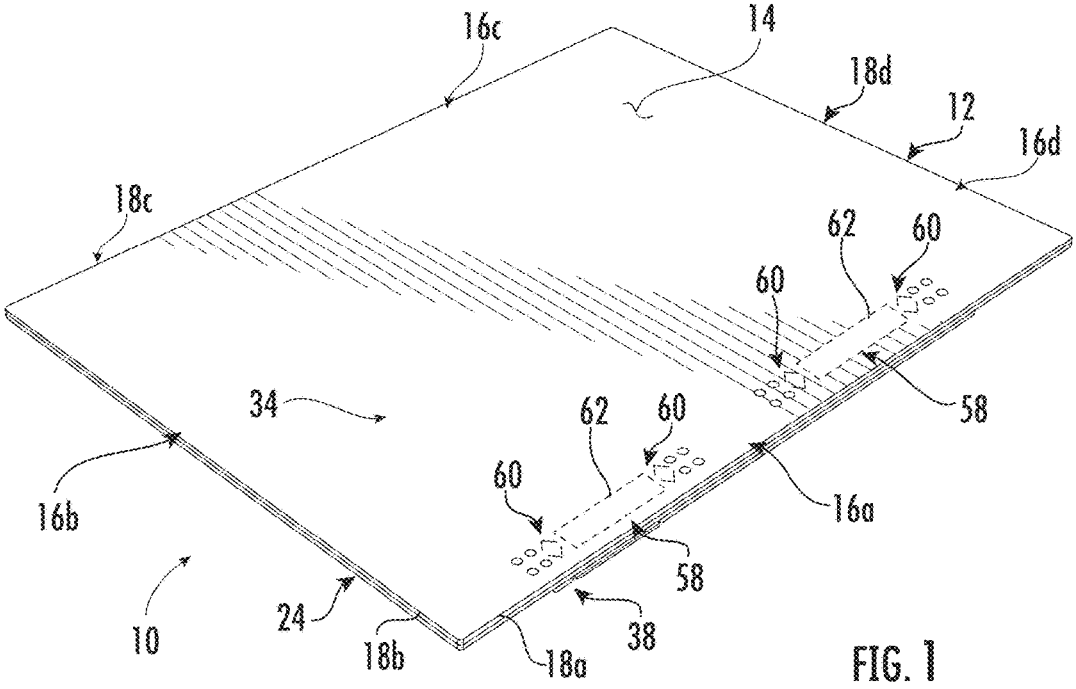
FIG. 1 is a top perspective view of a cooking hob according to an aspect of the disclosure.
Figure 2:
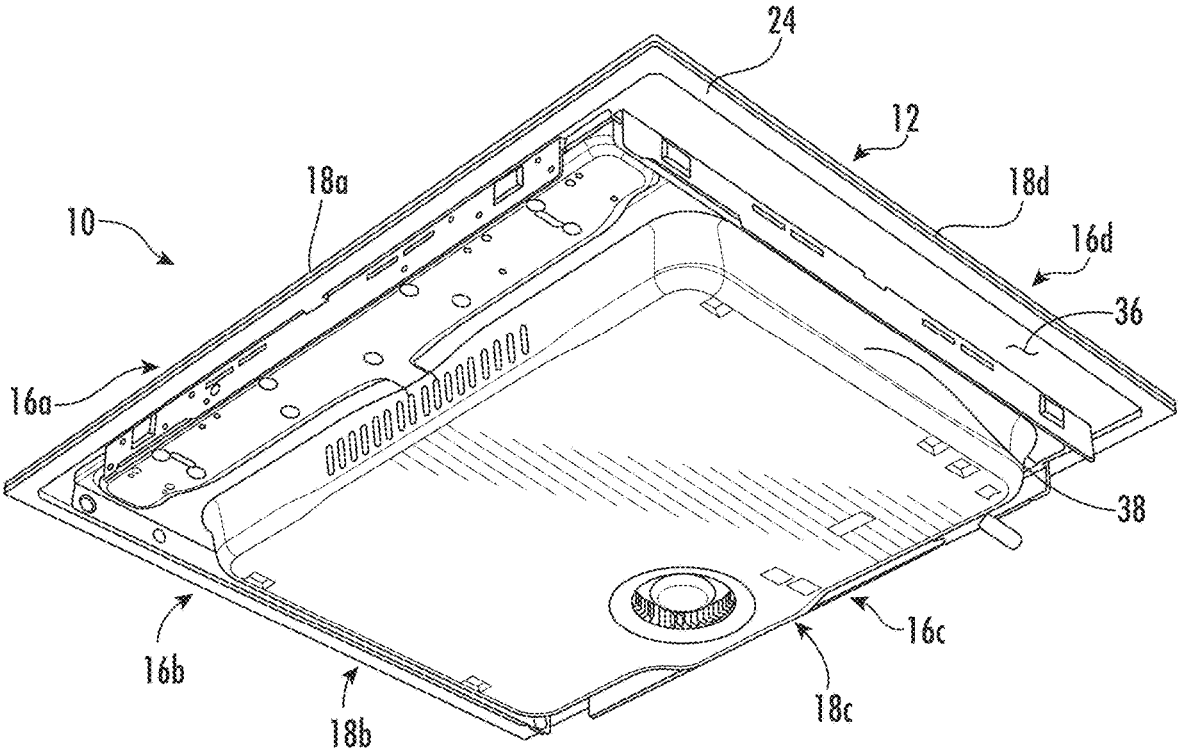
FIG. 2 is a bottom perspective view of the cooking hob.
Figure 3:
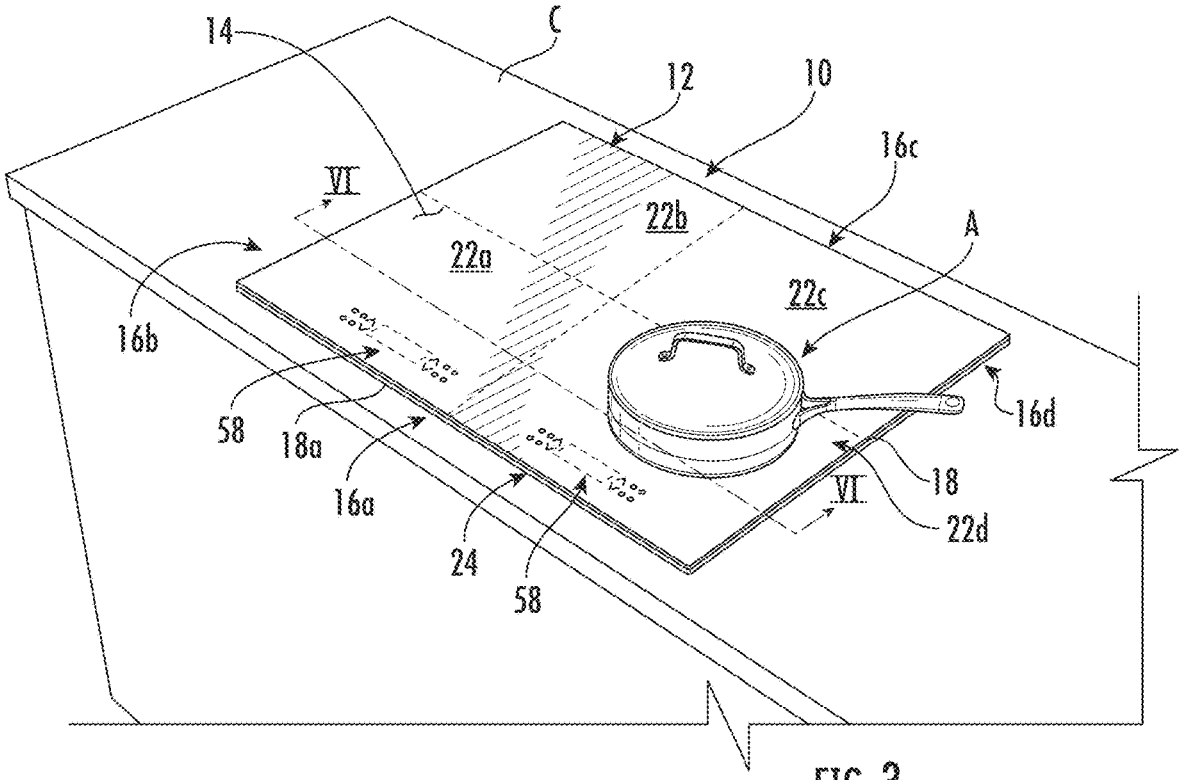
FIG. 3 is a top perspective view of the cooking hob in place within a countertop and having a cooking article placed thereon.

The components in the figures are not necessarily to scale, emphasis instead being placed upon illustrating the principles described herein.

DETAILED DESCRIPTION OF EMBODIMENTS

The present illustrated embodiments reside primarily in combinations of apparatus components related to an anti-rotation feature for a burner. Accordingly, the apparatus components have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that article or apparatus that comprises a list of elements does not include only those elements but may include other elements not expressly listed or inherent to such article or apparatus. An element proceeded by "comprises a . . . " does not, without more constraints, preclude the existence of additional identical elements in the article or apparatus that comprises the element.

Referring to the embodiment illustrated in FIGS. 1-9, reference numeral 10 generally designates a cooking hob. Cooking hob 10 includes a cooktop 12 defining a major surface 14 extending between a plurality of sides 16*a*,16*b*,16*d*,16*c* and a plurality of edge surfaces 18*a*,18*b*,18*c*,18*d* extending away from the major surface 14 at respective sides 16*a*,16*b*,16*d*,16*c* thereof and a plurality of burner 20 units (FIG. 4) disposed at the major surface 14 within respective sections 22*a*,22*b*,22*c*,22*d* of the major surface 14. The cooking hob 10 further includes a lighting assembly 24 affixed with the cooktop 12 opposite the major surface 14 and extending adjacent at least two of the sections 22*a*,22*b*,22*c*,22*d* of the major surface 14 and including at least one lighting element 26 (FIG. 4) exposed at respective portions of the edge surfaces 18*a*,18*b*,18*c*,18*d* corresponding with the sections 22*a*,22*b*,22*c*,22*d* of the major surface.

With reference to the example depiction of the cooking hob 10 discussed herein, the lighting assembly 24, as described further below, is useable to indicate the use or other activity or state associated with the burner units 20 within one or more of the sections 22*a*,22*b*,22*c*,22*d* of the major surface 14 of cooktop 12. In this respect, and as described further below, the cooking hob 10 can be configured to cause illumination of the various lighting assemblies 24 along the portions of the sides 16*a*,16*b*,16*d*,16*c* that are within, adjacent, or bound the outer portions of the sections 22*a*,22*b*,22*c*,22*d* upon activation of the burner unit(s) 20 associated with such sections 22*a*,22*b*,22*c*,22*d*. As can be appreciated, such activation can be made separately according to the activation or use of the burner units 20, as provided by cooking hob 10. In this respect, the principles of the use of lighting assembly 24 discussed herein can apply to various shapes or configurations of cooking hobs 10 that can otherwise conform to the principles of the present disclosure. Accordingly, while the present cooking hob 10 is illustrated herein as having a cooktop 14 having a rectangular shape defined by sides 16*a*,16*b*,16*d*,16*c* with the configuration of cooking hob 10 (e.g., by the positioning of the various controls discussed below) useable in connection with a counter C (FIG. 3) with sides 16*a* and 16*c* being generally positioned toward the front and back, respectively, and sides 16*b* and 16*d* being positioned to the left and right sides thereof (e.g., with respect to a user), the lighting assembly 24 and use thereof described herein can be adapted to cooking hobs having different shapes, forms and proportions. Still further, while the present cooking hob 10 is depicted as a stand-alone, counter-mounted unit, the present lighting assembly 24 can be incorporated and utilized in a cooking hob that is integrated with an oven in the form of a range-style cooking appliance (including with controls incorporated in locations differing from those depicted herein).

As discussed within the context of the example cooking hob 10 of FIGS. 1-9, to implement the burner unit 20 use indication discussed herein, the lighting assembly 24 extends along at least three of the edge surfaces, namely the front edge surface 18*a*, the right edge surface 18*b*, and the left edge surface 18*c*. In this respect, portions of the lighting assembly 24 are positioned to respectively bound at least the outer portions of each of the sections 22*a*,22*b*,22*c*,22*d* of the major surface 14, such sections 22*a*,22*b*,22*c*,22*d* being respectively associated with the areas of major surface 14 overlying the separately-controllable burner units 20, as shown in FIGS. 1-4, for example. It is noted that in the depicted arrangement of cooktop 14 with respect to the sections 22*a*,22*b*,22*c*,22*d* thereof, it may be possible to include separate lighting assemblies along only two opposite, parallel sides 16*a* and 16*c* or 16*b* and 16*d*, as each such section 22*a*,22*b*,22*c*,22*d* would still have a portion of one of the lighting assemblies extending along an outer portion (edge) thereof. A more clear indication of not only the use of the sections 22*a*,22*b*,22*c*,22*d*, but the relative sizes thereof may be achieved by utilizing the illustrated lighting assembly 24, which extends along additional portions of at least the front sections 22*a*,22*b*. As shown, at least one of the sections 22*a*,22*b*,22*c*,22*d* of the major surface 14 of cooktop 12 is located in a corner 26*a*,26*b*,26*c*,26*d* of the major surface 14 such that respective portions of two adjacent edge surfaces 18*a*,18*b*,18*c*,18*d* correspond with the at least one section 22*a*,22*b*,22*c*,22*d* of the major surface 14 (for example, portions of edge surfaces 18*a* and 18*b* correspond with section 22*a*, with similar correspondence being indicated in the Figures). In this respect, the depicted lighting assembly 24 extends around the entire perimeter (i.e., all four sides 16*a*,16*b*,16*d*,16*c*) of cooktop 12. This arrangement provides portions of lighting assembly 24 extending along two sides of each of the sections 22*a*,22*b*,22*c*,22*d* as, all four of the sections 22*a*,22*b*,22*c*,22*d* of the major surface 14 are located in respective corners 26*a*,26*b*,26*c*,26*d* of the major surface 14. Stated differently, the example arrangement is such that respective portions of all four edge surfaces 18*a*,18*b*,18*c*,18*d* correspond with two each of the four sections 22*a*,22*b*,22*c*,22*d* of the major surface 14.

Figure 4:
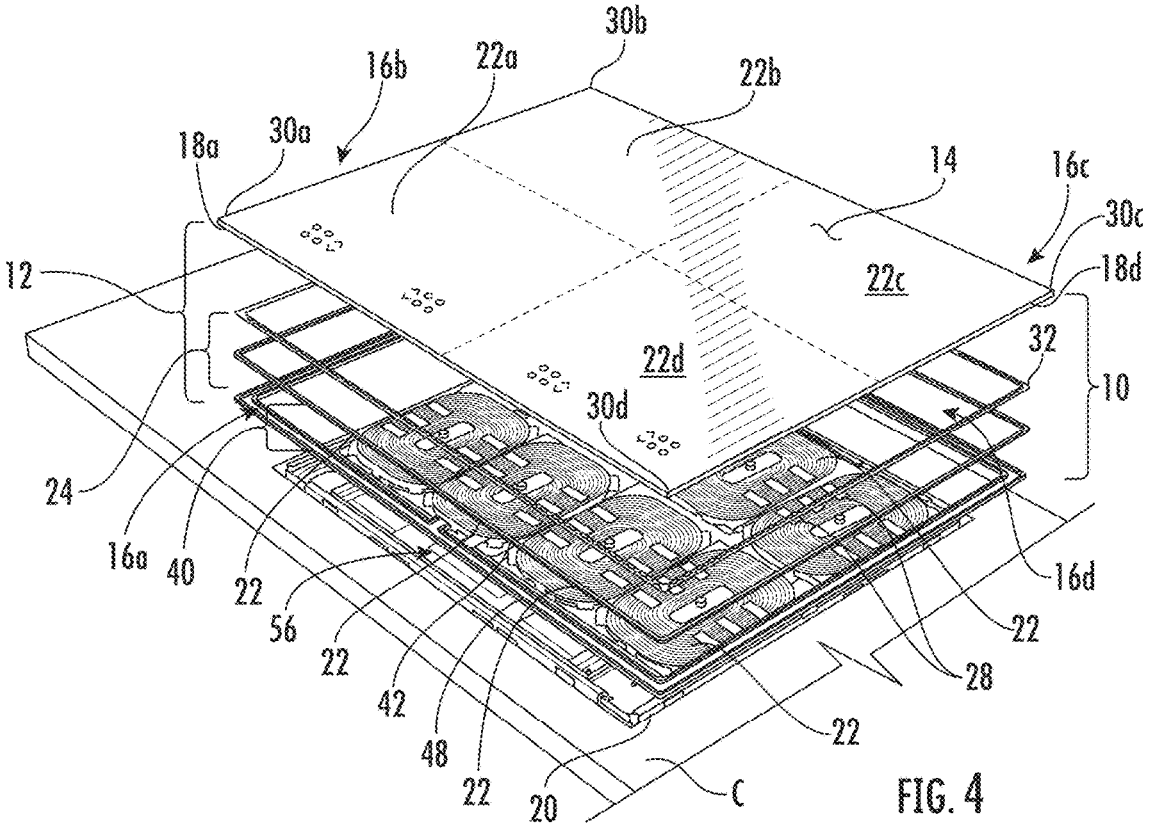
FIG. 4 is a top perspective exploded view of the cooking hob in place within the countertop.
Figure 5:
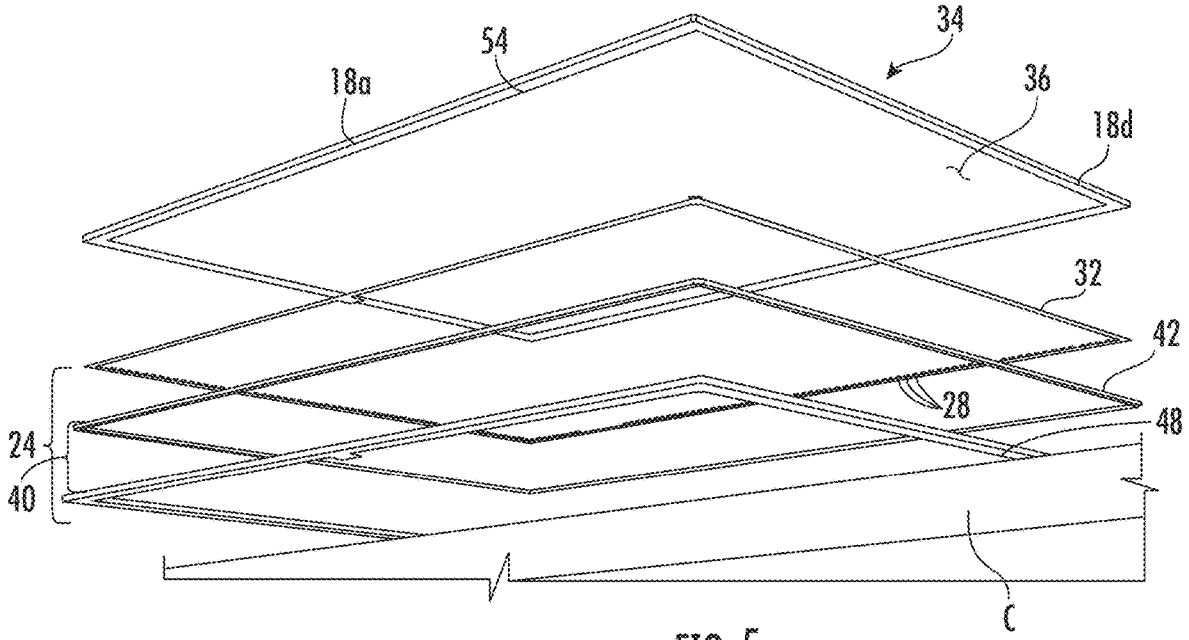
FIG. 5 is a bottom perspective exploded view of the cooking hob in place within the countertop.
Figure 6:
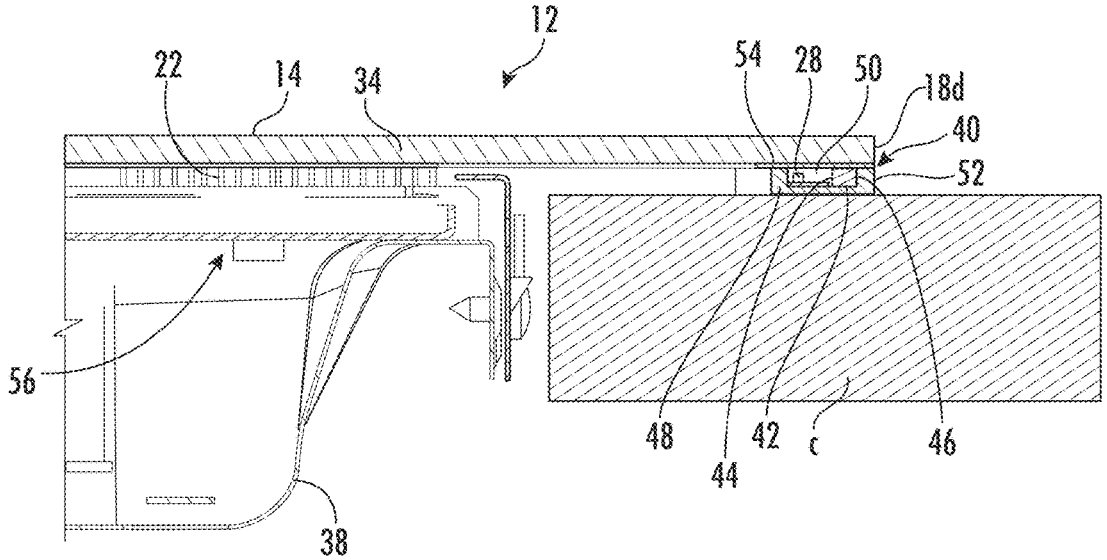
FIG. 6 is a partial side cross-section view of the cooking hob in place within the countertop.

As shown in FIGS. 4-6, to provide illumination for the portions of edge surfaces 18*a*,18*b*,18*c*,18*d* corresponding with active ones of the sections 22*a*,22*b*,22*c*,22*d* of major surface 14, lighting assembly 24 includes a plurality of lighting elements 28 directed outwardly from the edge surfaces 18*a*,18*b*,18*c*,18*d* adjacent at least portions of each of the sections 22*a*,22*b*,22*c*,22*d* of the major surface 14. In general, the lighting elements 28 are selectively illuminable to identify a section 22*a*,22*b*,22*c*,22*d* of the major surface 14 when the associated burner elements 22 are in an active state. As shown in FIG. 4, the lighting assembly 24 includes a set of light emitting diodes ("LEDs") spaced around the entirety of lighting assembly 24 at regular intervals. In one example, the LED lighting elements 28 can be mounted on a substrate configured for providing the desired electricity thereto in a manner that allows the LED lighting elements to at least be activated independently in groups corresponding with the sections 22*a*,226*b*,22*c*,22*d* of the major surface 14. In one example, the LED lighting elements 28 can be mounted on a rigid printed circuit board ("PCB") 32 and connected in parallel (or series) with a power source, with the PCB 32 corresponding with the portions of edge surfaces 18*a*,18*b*,18*c*,18*d* bounding the sections 22*a*,22*b*,22*c*,22*d*. In particular, the PCB 32 can extend around the respective corners 26*a*,26*b*,26*c*,26*d* of major surface and along each of the sides 16*a*,16*b*,16*d*,16*c* and, accordingly, through portions 30*a*,30*b*,30*c*,30*d* of the edge surfaces 18*a*,18*b*,18*c*,18*d* extending from such corners. In a variation, each edge surface 18*a*,18*b*,18*c*,18*d* can have two PCBs extending along portions 30*a*,30*b*,30*c*,30*d* thereof, such that two PCBs correspond with respective sides of the sections 22*a*,22*b*, 22*c*,22*d* of major surface. In such an arrangement, the LED lighting elements 28 can be mounted on PCB 32 with circuitry associated with the various LED lighting elements 28 such that the illumination thereof can be controlled individually, or at least in small groups (e.g. 3-12) of LED lighting elements 28.

In an alternative arrangement, the LED lighting elements 28 can be mounted on separate flex circuits in a similar manner as the above-described PCB. In such an arrangement, the flex circuit can collectively provide an electrical current to the lighting elements in groups generally corresponding with the portions 30*a*,30*b*,30*c*,30*d* of the sides 16*a*,16*b*,16*d*,16*c* partially bounding the sections 22*a*,22*b*, 22*c*,22*d* of major surface 14. In this manner, the PCB 32 can extend around the respective corners 26*a*,26*b*,26*c*,26*d* of major surface 14 and along about half each of the edge surfaces 18*a*,18*b*,18*c*,18*d*, as extending from such corners.

In a further alternative, the lighting elements 28 can be chip-on-board ("COB") LED units that can extend along the portions of both of the edge surfaces 18*a*,18*b*,18*c*,18*d* associated with each of the sections 22*a*,22*b*,22*c*,22*d*, respectively, such that each section includes only two such COB LED lighting elements 28 associated therewith. In a similar variation, the lighting elements 28 can be in the form of fluorescent lighting elements, including tubes that can extend along the portions of one, or both, of the edge surfaces 18*a*,18*b*,18*c*,18*d* associated with each of the sections 22*a*,22*b*,22*c*,22*d*. The circuitry associated with such variations in the form of the lighting elements 28 can vary accordingly.

As further shown in FIGS. 4-6, the cooktop 12 includes a substrate 34 that overlies the burner units 20 with the major surface 14 and edge surfaces 18*a*,18*b*,18*c*,18*d* being defined thereon. In such construction, the substrate 34 may be of a glass-ceramic material, although other materials and corresponding arrangements are possible. The substrate 34 further defines a lower surface 36 opposite the major surface 14. As shown, the lighting assembly 24 is arranged and positioned with respect to cooktop 12 such that it is adjacent the lower surface 36 of substrate 34. In this respect, the lighting assembly 24 (or at least the operative portions thereof) are positioned outside of the housing 38 that encloses the burner units 20 and other electronic circuitry and related mechanical elements of cooking hob 10 and to which substrate 34 is mounted. As can be seen in FIG. 6, the positioning of substrate 34 on housing 38 is such that substrate 34 extends outwardly beyond housing 38 so as to overlie the portion of countertop C into which housing 38 is mounted. This positioning can, further, be such that the substrate 34 is positioned above counter C with lighting assembly 24 received between counter C and substrate 34. In one aspect, by positioning the lighting assembly 24 outside of housing 38 isolates the lighting assembly (in particular LED lighting elements 28, which may be particularly sensitive to heat) from the interior of housing 38, which may reach temperatures that could damage or reduce the useful lifespan of lighting assembly 24.

The illustrated arrangement may be particularly useful in the present example, wherein the burner units 20 are induction coils. In this respect, induction burner units 20 do not produce heat as a means to cook items, but rather cause cooking articles A (FIGS. 7-9) of an appropriate composition to become heated using the principle of electromagnetic induction. Accordingly, induction burner units 20 do not visibly change in appearance due to heat, as do resistive heating elements and produce no visible flame, as do gas burners. At least because the articles A positioned on cooktop 14 can become heated, it is still useful to provide a visible indication of burner unit 20 use. Further, the coils of induction burner units 20 and the related circuitry for providing and controlling the flow of electrical current therethrough handle (and sometimes dissipate) a significant amount of electricity such that some resistive heat is still generated within housing 38 to the extent that it could be damaging to sensitive components, including LED lighting elements 28. In this respect, the LED lighting elements remain isolated from the components within housing 38, while the "edge lighting" effect provided thereby can still effectively communicate the use of burner units 20.

As further shown in FIGS. 4-6, lighting assembly 24 includes a light guide 40 that extends around the perimeter of substrate 34 defined by the sides 16*a*,16*b*,16*d*,16*c* thereof. As shown in FIGS. 4 and 6, in particular, the PCB 32 and associated LED lighting elements 28 are positioned within light guide 40 at least such that the LED lighting elements are positioned inwardly of the respective edge surfaces 18*a*,18*b*,18*c*,18*d* beneath lower surface 36 and such that at least a portion of light guide 40 is positioned outward of the lighting elements 28. In this manner, light guide 40 can be configured to distribute light emitted from the spaced-apart LED lighting elements 28 in a more even and consistent manner outwardly from edge surfaces 18*a*,18*b*,18*c*,18*d*. In the illustrated example, light guide 40 can include a diffuser portion 42 laterally aligned with and spaced outwardly from LED lighting elements 28. Diffuser portion 42 can be of a generally transparent polymeric material (e.g., acrylic, polycarbonate, or the like) and can include a roughened or otherwise textured inner surface 44 and outer surface 46 to allow light to enter and enter diffuser portion 42 in a generally even manner and to evenly diffuse light exiting diffuser portion 42 through outer surface 46. In this manner, one or both of inner surface 44 and outer surface 46 can incorporate prisms or lenticular elements to promote even distribution of light by way of diffuser portion 42. The remaining surfaces of diffusion portion 42 can have a smooth or polished surface quality to reflect light internally within diffusion portion 42 away from such surfaces and toward outer surface 46, in particular. In a variation, separate diffuser portions can be associated with each section 22*a*-22*d*, which can be physically separated by being spaced apart or by having an opaque element therebetween. Such an arrangement may provide a more clear indication of the ends of the respective sections 22*a*-22*d*.

As further shown in FIGS. 4 and 6, light guide 40 can also include a housing portion 48 that defines an interior cavity 50 in the form of a channel that extends around housing portion 48. Both the PCB 32 and associated LED lighting elements 28 and the diffuser portion 42 are received in cavity 50 with LED lighting elements 28 positioned inward of diffuser portion 42, as discussed above. Housing portion 48 defines an outer surface 52 and is configured such that outer surface 52 is generally flush with the adjacent edge surface 18*a*,18*b*,18*c*,18*d* of substrate 34 such that light guide 40 achieves a consistent appearance with substrate 34, particularly when LED lighting elements 28 are not illuminated. In this manner, the finish applied to outer surface 52 can be configured to be generally visually similar to that of the edge surfaces 18*a*,18*b*,18*c*,18*d*, or at least as visually similar as practical, without resulting in internal reflection within housing portion 48 that could potentially diminish the visibility and desired diffusion of the light from LED lighting elements 28 through light guide 40 and outwardly from edge surfaces 18*a*,18*b*,18*c*,18*d*.

As shown in FIGS. 5 and 6, cooktop 12 further includes a masking layer 54 extending at least along portions of the lower surface 36 of substrate 34 adjacent the edge surfaces 18*a*,18*b*,18*c*,18*d* such that the Led lighting elements 28 are positioned beneath the masking layer 54. As can be appreciated, the construction of the glass-ceramic substrate 34 of the present example results in an at least partially transparent appearance. Given the illustrated positioning of LED lighting elements 28 beneath substrate 34, a portion of the light emitted from LED lighting elements 28 is directed toward the surface. Accordingly, mask layer 54 prevents light from leaking through to major surface 14 for clarity and/or aesthetic purposes. In at least this respect, the masking layer 54 is of an opaque material or construction and extends inwardly from adjacent edge surfaces 18*a*,18*b*,18*c*,18*d* inward toward housing 38 (at least to extend over the portions of lower surface 36 on which the light from LED lighting elements 28 is incident). Additionally, masking layer 54 can be configured to promote reflection or light toward and outward from the edge surfaces 18*a*,18*b*,18*c*,18*d* and/or the diffusion of light from LED lighting elements 28 to a uniform appearance. In this respect, masking layer 54 can have a light-colored (including white) or reflective appearance at least on the side thereof disposed toward LED lighting elements 28 and/or can be of a roughened texture. It can be appreciated that, in some application, a dart appearance is desired for major surface 14, in which case, the masking layer 54 can be of a multi-layered construction (including of different materials, or by application of paint, pigment, or the like) with the layer contacting lower surface 36 being of a darker color (e.g. black, dark grey or the like). In various applications, the masking layer 54 can be of a polymeric material (including of multiple layers) adhered to lower surface 35 of substrate 43 or a paint or other coating applied onto lower surface 36 of substrate 34, including by screen-printing or the like (and, if desired, in multiple layers).

As can be appreciated cooking hob 10 includes electronic circuitry 56, at least a portion of which is visible in FIG. 4, to allow for controlled activation and use of the burner units 20. Such electronic circuitry 56 can be configured, as needed, to receive inputs from the particular controls 58 associated with the cooking hob 10 and to deliver power (e.g. electrical current) to the burner units 20 in an appropriate manner for the particular type of burner unit 20. As presently-illustrated, cooking hob 10, the controls 58 are in the form of capacitive-touch areas or buttons 60 configured to operate as buttons to raise and lower the power provided to the burner units 20 within each of the sections 22*a*,22*b*,22*c*,22*d* of major surface 14, respectively. Accordingly, the electronic circuitry 56 will include circuitry to implement the capacitive touch functionality, as well as a controller in the form of a microprocessor or microcontroller and related memory (which may be implemented using an application-specific integrated circuit ("ASIC") and/or system-on chip architecture, or the like) to receive user inputs from the buttons and associate them with a desired power level or change in power level of the burner units 20 in a specific section 22*a*,22*b*,22*c*,22*d* and to provide the desired current flow for the corresponding burner units 20. In this manner, the electronic circuitry 56 can include additional wiring, transformers, controllers, and the like needed to operate the present induction burner units 20.

Figure 7:
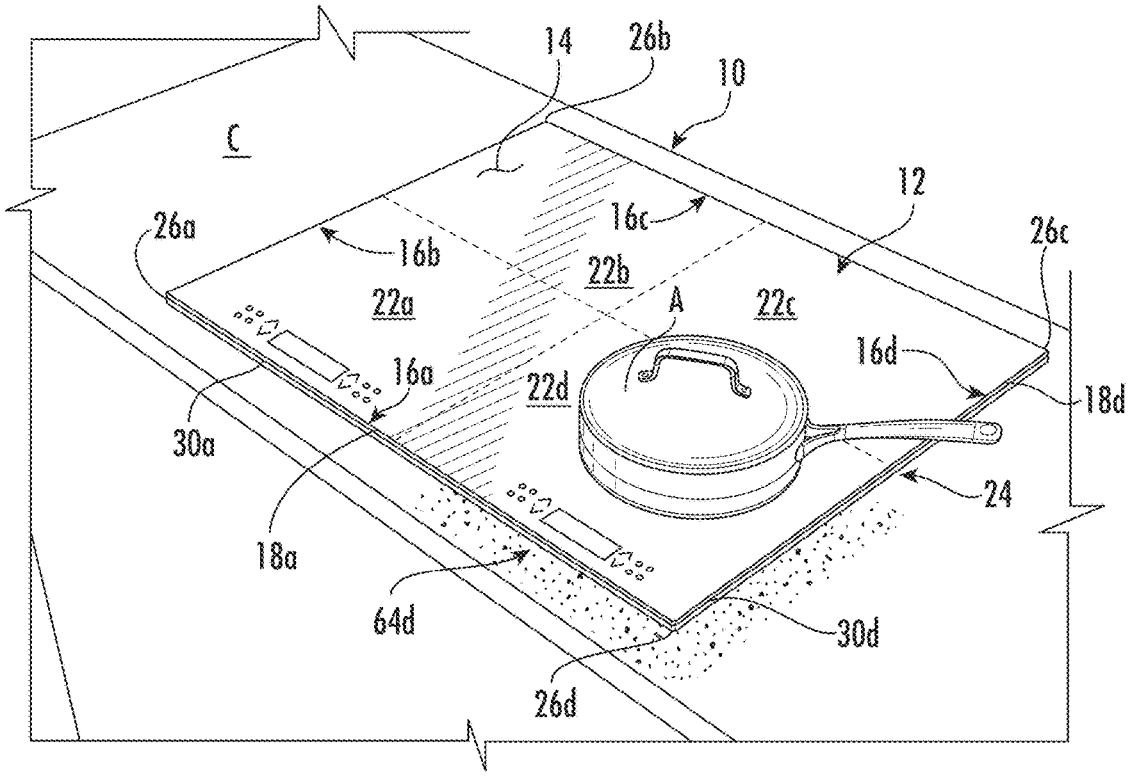
FIG. 7 is a top perspective view of the cooking hob in place within the countertop and having the cooking article placed thereon with an example edge lighting effect indicating use of burner units associated with an area of the cooktop in which the article is present.

In the present cooking hob 10, the electronic circuity can further include circuitry for operating the lighting elements 28 to indicate use of the respective sections 22*a*,22*b*,22*c*,22*d* of cooktop 12. In this respect, the above-described controller can be programmed or otherwise configured to correlate the inputs from controls 58 and certain ones of the accordingly-determined operational parameters of burner units 20 with control signals for operating the LED lighting elements 28 in a predetermined manner to indicate use of the burner units 20. In this respect, the electronic circuitry 56 may further include wiring or the like to deliver the signals from the controller to the PCB 32 (or other structure to which the lighting elements 28 are electrically and physically mounted). As shown in FIG. 7, the result of such programming and configuration is such that, when the burner unit(s) 20 within section 22*b* is(/are) activated, the electronic circuitry 56, including the controller, can cause the LED lighting elements 28 in the portion 30*b* of lighting assembly 24 aligned with or bounding section 22*b* to illuminate to indicate use of the burner unit(s) 20 to heat cooking article $A_1$. As further illustrated, the positioning and configuration of lighting assembly 24, as discussed above, can cause the light from the illuminated lighting elements 28 to illuminate the adjacent portions of the counter C, which may make the indication of use of section 22*b* generally more apparent to an observer.

Figure 8:
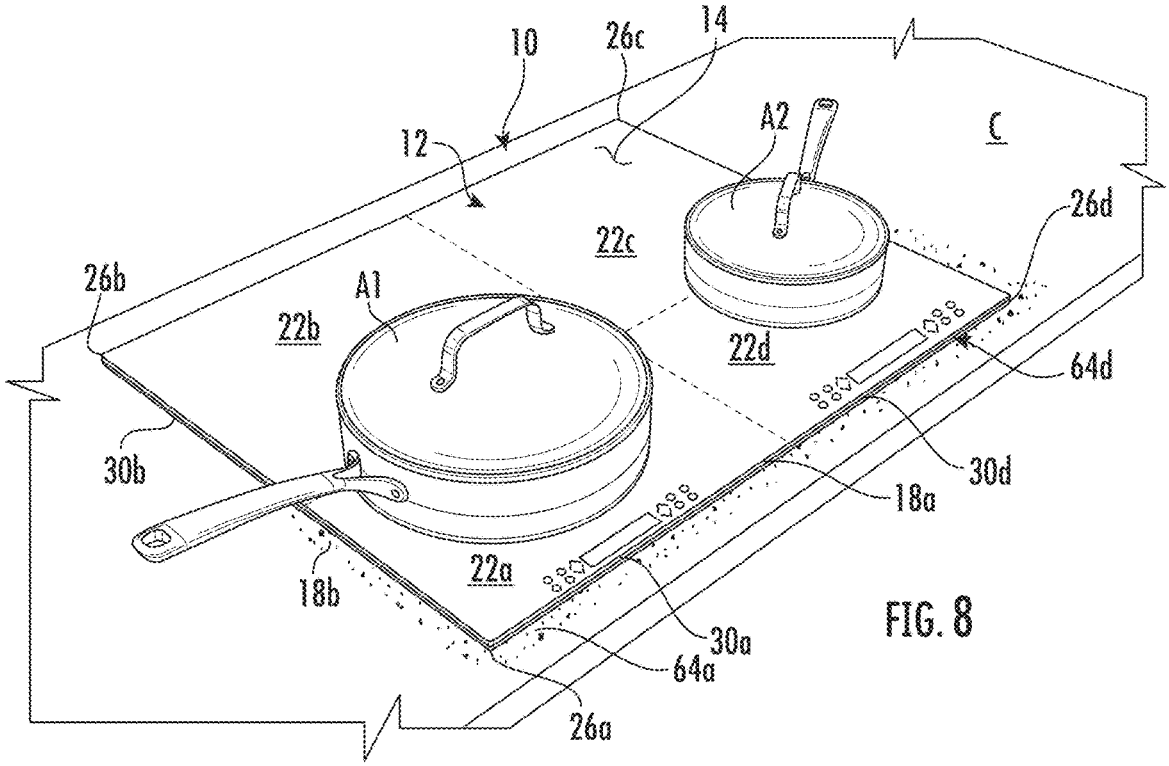
FIG. 8 is a top perspective view of the cooking hob in place within the countertop and having multiple cooking articles placed thereon with a further example edge lighting effect indicating use of burner units associated with areas of the cooktop in which the articles are present.
Figure 9:
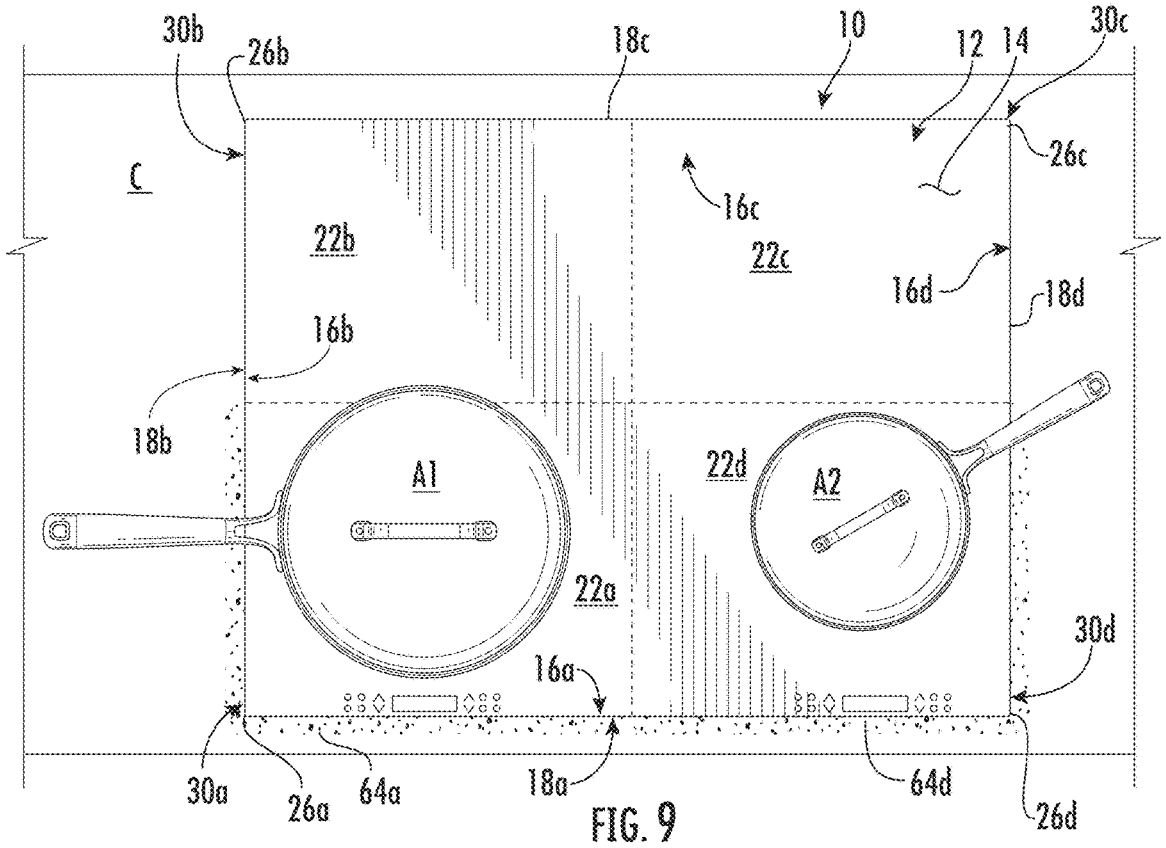
FIG. 9 is a top view of the cooking hob in place within the countertop and having multiple cooking articles placed thereon with the further example edge lighting effect indicating use of burner units associated with areas of the cooktop in which the articles are present.

As shown in FIGS. 8 and 9, when the burner unit(s) 20 corresponding with section 22*a* are activated, by user inputs with the appropriate capacitive buttons 60 or other controls 58, the controller can additionally cause the LED lighting elements 28 in the portion 30*a* of lighting assembly 24 aligned with or bounding section 22*a* to illuminate to indicate use of the burner unit(s) 20 to heat cooking article $A_2$. In this respect, the various portions 30*a*,30*b*,30*c*,30*d* can be independently illuminated, to correspond with the independent use of the burner units 20 within the respective sections 22*a*,22*b*,22*c*,22*d*. In a further aspect, the illumination of the portions 30*a*,30*b*,30*c*,30*d* of lighting assembly 24 can be controlled to change in character (e.g. color and/or intensity) to further indicate the heating level at which the burner unit(s) 20 are being operated.

In one aspect, the electronic circuitry 56, including the controller, can be configured to detect a magnetic field through burner units 20 by providing a low-level current thereto when cooking hob 10 is in an overall "on" state, but when no command to heat any articles has been received or when all burner units are otherwise in an inactive or standby state. In such an example, the electronic circuitry 56 can detect when a cooking article $A_1$,$A_2$ is present on major surface 14 and the particular section 22*a*,22*b*,22*c*,22*d* on which it has been placed. Accordingly, when an article $A_1$,$A_2$ is placed on one of the sections 22*a*,22*b*,22*c*,22*d* of major surface, the electronic circuity can detect such positioning and illuminate the corresponding portion 30*a*,30*b*,

30*c*,30*d* of lighting assembly 24 in a particular color for indicating that the article has been detected, such as blue or the like. Further, when the burner unit(s) 20 associated with the section 22*a*,22*b*,22*c*,22*d* within which an article A1,A2 has been placed is activated, the color in which the corresponding portion 30*a*,30*b*,30*c*,30*d* of lighting assembly 24 can be changed to correspond with the power/heating level of such activation to communicate the potential heat of the corresponding article A.

In various examples, the color of the portion 30*a*,30*b*, 30*c*,30*d* of lighting assembly can be illuminated in yellow for a low power setting (e.g., from greater than 0 to 30%), orange for a medium power setting (e.g., from greater than 30% to about 60%), and red for a high power setting (e.g., from greater than 60% to 100% power). In various examples, the lighting assembly 24 can be configured to have its portions 30*a*,30*b*,30*c*,30*d* illuminated in such colors by way of providing multiple LED lighting elements 28 (or multiple diodes in a single unit) within respective portions 30*a*,30*b*,30*c*,30*d* in different colors (e.g., red, green, and blue) that can be illuminated in various combinations, including by intensity, to achieve the desired color, with the electronic circuitry (such as by the controller itself or separate controllers associated with the PCB or the like) being configured to implement such illumination configurations. Because such a lighting assembly 24 and associated controls may be capable of illumination across a spectrum of colors such the transition from yellow to red can be implemented gradually, for example, with each change in power level corresponding to each tap on the capacitive buttons 60. It is noted that the power level of each section 22*a*,22*b*,22*c*, 22*d* can also be presented on a display 62 coupled with the electronic circuitry 56, including by a numeric representation thereof.

As can be appreciated from the depiction of cooking hob 10 in FIG. 4, the present cooking hob 10 includes two induction coils for the burner units 20 in each respective section 22*a*,22*b*,22*c*,22*d*. Such a configuration may be implemented in other forms of induction cooking hobs 10 and allows for an appropriate magnetic field for induction heating over the entirety of each section 22*a*,22*b*,22*c*,22*d*, which can allow for heating of larger articles or of smaller articles positioned away from the geometric center of such sections 22*a*,22*b*,22*c*,22*d*. In this respect, in the example of FIGS. 1-9, the electronic circuitry operates both burner units simultaneously and at the same level, given the user input corresponding therewith, regardless of whether the article A thereon is positioned over both burner units 20 to appreciable degree. In the alternative, the electronic circuitry 56 can detect the presence of an article A, as discussed above, individually, with respect to the burner units 20. In this manner, the power provided to the burner units 20 can be adjusted depending on the presence of an article A thereover. In the present example, the illumination of the portions 30*a*,30*b*,30*c*,30*d* of lighting assembly 24 is carried out without considering which of the two burner units 20 is actually active, with the entire portions 30*a*,30*b*,30*c*,30*d* being illuminated with the either burner unit 20 in the corresponding section 22*a*,22*b*,22*c*,22*d* is active.

Figure 10:
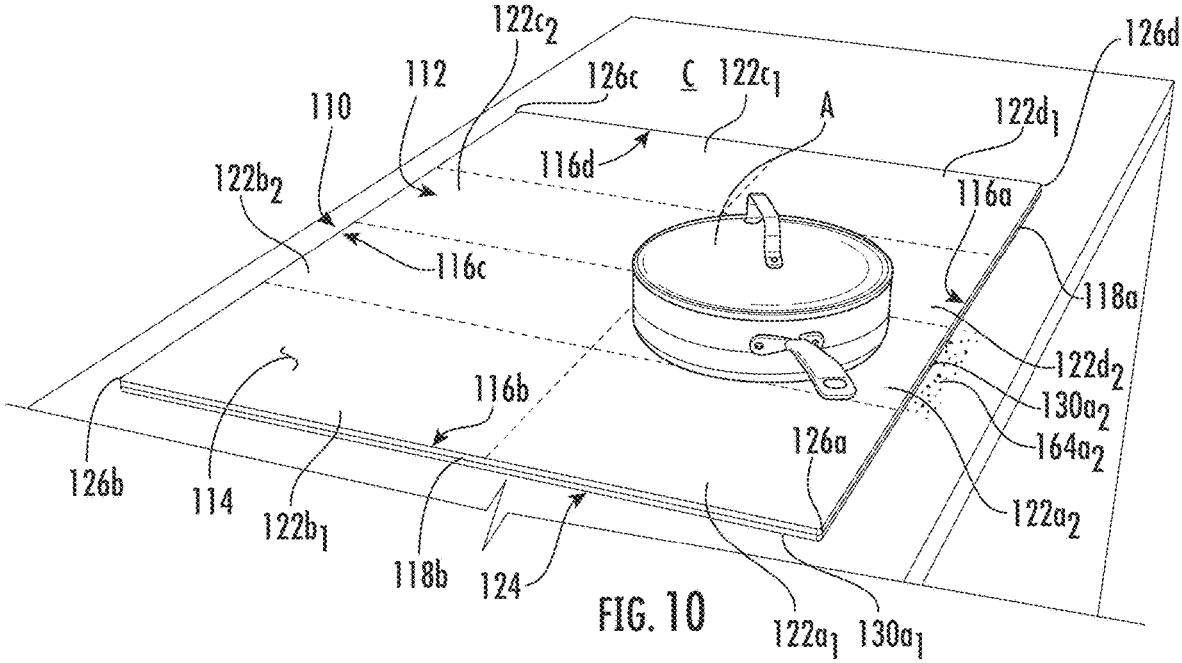
FIG. 10 is a top perspective view of an alternative cooking hob in place within a countertop and having a cooking article placed thereon with an example edge lighting effect indicating use of a burner unit associated with a sub-area of the cooktop in which the article is present.
Figure 11:
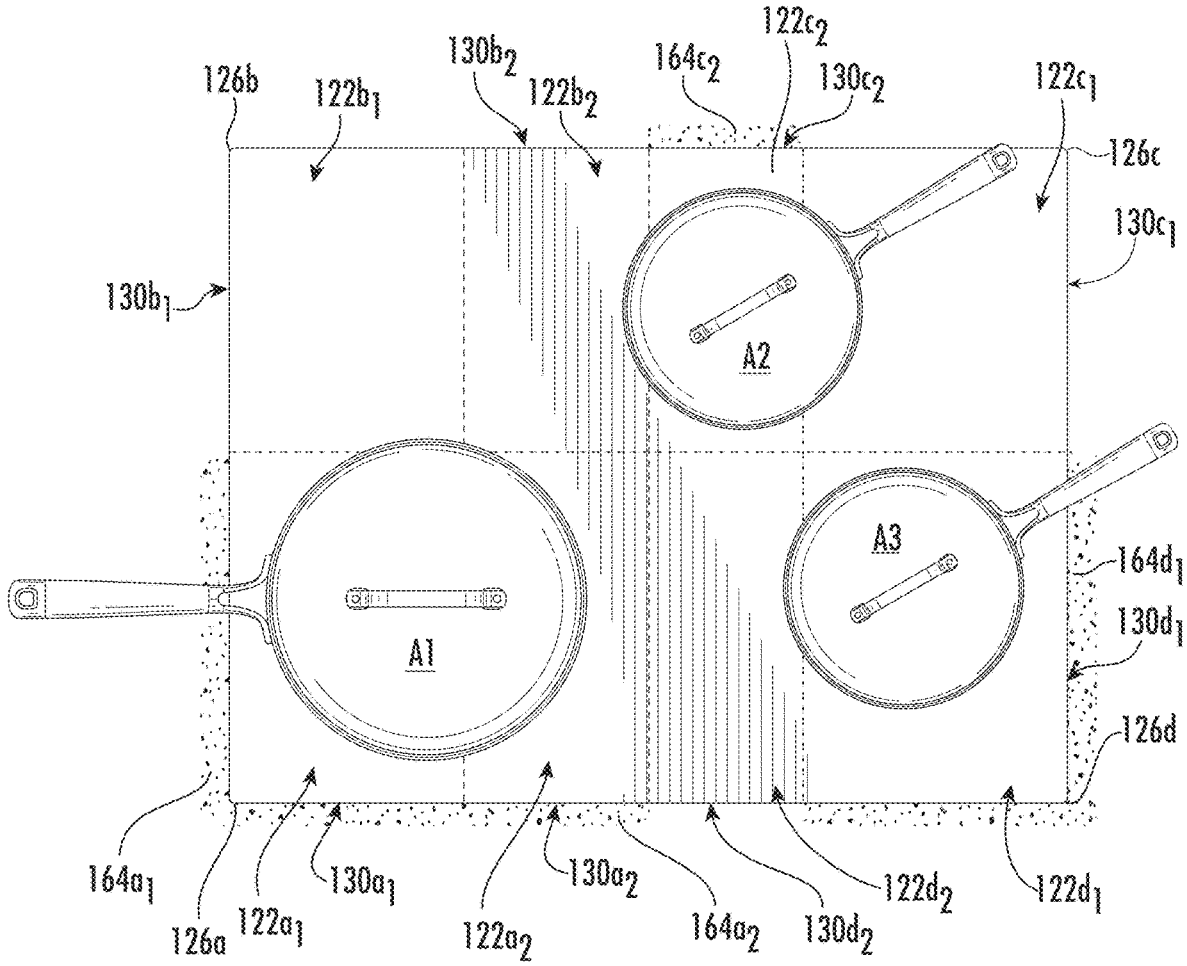
FIG. 11 is a top view of the cooking hob in place within the countertop and having multiple cooking articles placed thereon with the further example edge lighting effect indicating use of burner units associated with sub-areas of the cooktop in which the articles are present.

In an alternative arrangement, as shown in FIGS. 10 and 11, the lighting unit 128, PCB 132, and/or associated electronic circuitry can be configured to illuminate various subsections 122*a*1,122*a*2,122*b*1,122*b*2, etc. that correspond with the individual burner units (which can be of the same configuration as burner units 20, as depicted in FIG. 4). As shown in FIG. 11, while some of the subsections (e.g. subsection 122$a_1$) remain positioned adjacent a corner 126*a* of major surface 114, other subsections (e.g. subsection 122$d_2$) is positioned away from corners 126*a*,126*b* such that the sub-portion 130$d_2$ of lighting assembly 124 associated therewith extends along only a portion of one edge 118*a*. In this example, the illumination of the various subsections 122$a_1$,122$a_2$,122$b_1$,122$b_2$, etc. can be implemented in a variation where the use is controlled by section 122*a*,122*b*, 122*c*,122*d* and the use of the subsections is dependent only on the presence of an article thereon. In such an example, multiple smaller articles can be positioned on separate subsections, with both subsections indicating use at the same level, per the control scheme. In a further example, an unused subsection within an active section can be illuminated in a different color (such as white, for example) than the section being used (which can be illuminated according to the variations discussed above). In a further example, each subsection 122$a_1$,122$a_2$,122$b_1$,122$b_2$, etc. can be controllable independently.

It will be understood by one having ordinary skill in the art that construction of the described device and other components is not limited to any specific material. Other exemplary embodiments of the device disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

In various embodiments, the invention can be characterized in various clauses and various combinations thereof, including the following paragraphs:

A cooking hob, further including a masking layer extending along portions of the inner surface adjacent the at least two edge surfaces, wherein:

the plurality of lighting elements are positioned beneath the masking layer.

A cooking hob, wherein the masking layer defines a diffusing surface disposed toward the lighting elements.

A cooking hob, wherein the burner units are induction heating units and are positioned adjacent the lower surface.

A cooking hob, wherein each of the plurality of lighting elements are light-emitting diodes included in an arrangement of interconnected light-emitting diodes that extends through the at least two of the sections of the major surface with respective pluralities of the light-emitting diodes exposed at the respective portions of the edge surfaces corresponding with the sections of the major surface.

A cooking hob, wherein at least one of the sections of the major surface is located in a corner of the major surface such that respective portions of two adjacent edge surfaces correspond with the at least one section of the major surface.

A cooking hob, wherein four of the sections of the major surface are located in respective corners of the major surface such that respective portions of four edge surfaces correspond with two each of the four sections of the major surface.

A cooking hob, wherein at least one additional section of the major surface is located remote from at least two adjacent corners of the major surface such that a respective portion of only one of the four edge surface corresponds with the at least one additional section.

A cooking hob, wherein:

the cooktop defines four sides with four corresponding edge surfaces;

the sections of the major surface are respectively adjacent and bounded by one of the four sides; and the lighting assembly extends adjacent each of the four sides with respective ones of the plurality of lighting elements respectively exposed at portions of each of the edge surfaces.

A cooking hob, further including a controller for:

selectively activating at least one of the plurality of burner units for heating a cooking article on a corresponding section of the major surface; and selectively causing illumination of at least one of the lighting elements exposed on the portion of the edge surface respectively corresponding with the section of the major surface when the at least one of the plurality of burner units is activated.

A cooking hob, wherein the controller selectively activates the ones of the plurality of burners according to a user input including at least one of a burner unit location and a heating level.

A cooking hob, wherein the controller illuminates the respective portion of the at least one of the edges corresponding with the activated ones of the plurality of burner units corresponding with the burner unit location of the user input and at one of a brightness or color corresponding with the heating level of the user input.

A cooking hob, wherein:

the burner units are induction heating coils;

at least two of the burner units are disposed at the major surface within one of the respective sections; and the controller selectively activates the at least two burner units in the one of the respective sections simultaneously.

A cooking hob, wherein:

the at least two of the burner units are disposed at the major surface within respective individual subsections of the section of the major surface; and the controller selectively activates one of the at least two burner units and causes the lighting assembly to illuminate a respective portion of at least one of the edges bounding at least one of the subsections corresponding with the activated one of the two burner units based on at least one of a user input or a determination that a cooking article size is smaller than the respective section by a predetermined amount.

A cooking hob, wherein the cooktop further defines a plurality of side surfaces extending away from the edges of the major surface; and the lighting assembly is affixed with the cooktop opposite the major surface and extends adjacent at least two of the sections of the major surface and includes at least two lighting elements respectively exposed at respective portions of the edge surfaces corresponding with the sections of the major surface.

A cooking hob, wherein:

the cooktop is of a glass-ceramic substrate, the major surface and edge surfaces being defined thereon, and further defining a lower surface opposite the major surface;

the lighting assembly is affixed with the cooktop adjacent the inner surface and includes a light guide extending along portions of the inner surface adjacent the at least two edge surfaces and defining at least two outer faces extending generally contiguously with the at least two edge surfaces, respectively; and the at least two lighting elements are spaced inwardly of the light guides.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above is merely for illustrative purposes and not intended to limit the scope of the device, which is defined by the following claims as interpreted according to the principles of patent law, including the Doctrine of Equivalents.

What is claimed is:

1. A cooking hob, comprising:

a cooktop defining a major surface extending between a plurality of sides and a plurality of edge surfaces extending away from and perpendicular to the major surface at respective sides thereof;

a plurality of burner units disposed at the major surface within respective sections of the major surface; and a lighting assembly affixed with the cooktop opposite the major surface, extending adjacent at least two of the sections of the major surface and including a plurality of lighting elements, the lighting assembly including a light guide extending along portions of the inner surface adjacent at least two of the plurality of edge surfaces and defining at least two outer faces extending perpendicular to the major surface and generally contiguously with the at least two of the plurality of edge surfaces, respectively, and the lighting elements being respectively directed outwardly through respective ones of the outer faces adjacent portions of the edge surfaces corresponding with the sections of the major surface.

2. The cooking hob of claim 1, wherein:

the cooktop is of a glass-ceramic substrate, the major surface and edge surfaces being defined thereon, and further defining an inner surface opposite the major surface; and the lighting assembly is affixed with the cooktop adjacent the inner surface.

3. The cooking hob of claim 2, wherein:

and the plurality of lighting elements are spaced inwardly of the outer faces of the light guide.

4. The cooking hob of claim 2, further including a masking layer extending along portions of the lower surface adjacent respective ones of the at least two of the plurality of edge surfaces, wherein:

the plurality of lighting elements are positioned beneath the masking layer so as to be aligned therewith in a direction normal to the lower surface and to block light emanating from the lighting elements from passing through the cooktop such that the light is visible only through the outer faces of the light guide.

5. The cooking hob of claim 4, wherein the masking layer defines a diffusing surface disposed toward the plurality of lighting elements.

6. The cooking hob of claim 2, wherein the plurality of burner units are induction heating units and are positioned adjacent the lower surface.

7. The cooking hob of claim 1, wherein each of the plurality of lighting elements are light-emitting diodes included in an arrangement of interconnected light-emitting diodes that extends through the at least two of the sections of the major surface with respective pluralities of the light-emitting diodes exposed at the respective portions of respective ones of the plurality of edge surfaces corresponding with the sections of the major surface.

8. The cooking hob of claim 1, wherein at least one of the sections of the major surface is located in a corner of the major surface such that respective portions of two adjacent edge surfaces correspond with respective ones of the sections of the major surface.

9. The cooking hob of claim 8, wherein four of the sections of the major surface are located in respective corners of the major surface such that respective portions of four edge surfaces correspond with two each of the sections of the major surface.

10. The cooking hob of claim 9, wherein at least one additional section of the major surface is located remote from at least two adjacent corners of the major surface such that a respective portion of only one of the plurality of edge surfaces corresponds with the at least one additional section.

11. The cooking hob of claim 1, wherein:

the cooktop defines four sides with four corresponding edge surfaces;

the sections of the major surface are respectively adjacent and bounded by one of the four sides; and the lighting assembly extends adjacent each of the four sides with respective ones of the plurality of lighting elements respectively exposed at portions of each of the edge surfaces.

12. The cooking hob of claim 1, further including a controller for:

selectively activating at least one of the plurality of burner units for heating a cooking article on a corresponding section of the major surface; and selectively causing illumination of at least one of the lighting elements exposed on the portion of the one of the plurality of edge surfaces respectively corresponding with the section of the major surface when the at least one of the plurality of burner units is activated.

13. A cooking hob, comprising:

a cooktop defining a major surface extending between a plurality of sides with a corresponding plurality of edges bounding the major surface;

a plurality of burner units disposed at the major surface within respective sections of the major surface;

a lighting assembly extending along at least one of the plurality of edges and including a light guide extending along at least one of the plurality of edges past at least two sections of the major surface, the light guide defining at least two outer faces extending perpendicular to the major surface away from and aligned with the edge, the light guide further including a plurality of lighting elements and being configured to direct light from the plurality of lighting elements outward through the outer face; and a controller selectively activating ones of the plurality of burner units and causing the lighting assembly to illuminate a respective portion of at least one of the edges bounding at least one of the sections of the major surface corresponding with the activated ones of the plurality of burner units.

14. The cooking hob of claim 13, wherein the controller selectively activates the ones of the plurality of burner units according to a user input including at least one of a burner unit location and a heating level.

15. The cooking hob of claim 14, wherein the controller illuminates the respective portion of the at least one of the outer faces of the light guide corresponding with the activated ones of the plurality of burner units corresponding with the burner unit location of the user input and at one of a brightness or color corresponding with the heating level of the user input.

16. The cooking hob of claim 13, wherein:

each of the plurality of burner units are induction heating coils;

at least two of the plurality of burner units are disposed at the major surface within one of the respective sections; and the controller selectively activates the at least two burner units in the one of the respective sections simultaneously.

17. The cooking hob of claim 16, wherein:

the at least two of the plurality of burner units are disposed at the major surface within respective individual subsections of the respective section of the major surface; and the controller selectively activates one of the at least two burner units and causes the lighting assembly to illuminate a respective portion of at least one of the outer surface of the light guide along the portions of the edges bounding at least one of the subsections corresponding with the activated one of the two burner units based on at least one of a user input or a determination that a cooking article size is smaller than the respective section by a predetermined amount.

18. The cooking hob of claim 13, wherein the cooktop further defines a plurality of edge surfaces extending away from respective ones of the edges of the major surface; and the lighting assembly is affixed with the cooktop opposite the major surface and extends adjacent at least two of the sections of the major surface, wherein at least two of the plurality of lighting elements are respectively exposed at respective portions of the plurality of edge surfaces corresponding with the sections of the major surface by way of the outer faces of the light guide extending contiguously with the edge surfaces.

19. The cooking hob of claim 18, wherein:

the cooktop is of a glass-ceramic substrate, the major surface and edge surfaces being defined thereon, and further defining a lower surface opposite the major surface;

the lighting assembly is affixed with the cooktop adjacent the inner surface; and the at least two lighting elements are spaced inwardly of the light guides.

20. A cooking hob, comprising:

a cooktop defining a major surface extending between a plurality of sides and a plurality of edge surfaces extending away from and perpendicular to the major surface at respective sides thereof;

a plurality of burner units disposed at the major surface within respective sections of the major surface; and a lighting assembly extending along at least three of the edge surfaces and including a plurality of lighting elements spaced inwardly of the edge surfaces and beneath the major surface, the plurality of lighting elements being directed outwardly adjacent at least portions of each of the sections of the major surface, the lighting assembly being configured to emit light in a direction outward from the edge surfaces without illuminating the major surface, the lighting elements being selectively illuminable to identify a section of the major surface wherein the associated burner elements are in an active state.

* * * * *